United States Patent [19]

Herklotz et al.

[11] 4,382,805

[45] May 10, 1983

[54] SYSTEM FOR AUTOMATICALLY CONTROLLING THE BREAKDOWN VOLTAGE LIMIT OF AN ELECTROFILTER

[75] Inventors: Helmut Herklotz, Neu Isenburg; Günter Mehler, Frankfurt am Main; Franz Neulinger, Dietzenbach; Helmut Schummer, Heusenstamm; Horst Daar, Erlangen; Walter Schmidt, Uttenreuth; Heinrich Winkler, Neunkirchen, all of Fed. Rep. of Germany

[73] Assignee: Siemens Aktiengesellschaft, Munich, Fed. Rep. of Germany

[21] Appl. No.: 252,452

[22] Filed: Apr. 9, 1981

[30] Foreign Application Priority Data

Apr. 21, 1980 [DE] Fed. Rep. of Germany ..... 3015275

[51] Int. Cl.[3] ..... B03C 1/00

[52] U.S. Cl. ..... 55/2; 323/903

[58] Field of Search ..... 55/105; 323/903

[56] References Cited

U.S. PATENT DOCUMENTS

| | | | |
|---|---|---|---|
| 3,577,708 | 5/1971 | Drenning | 323/903 X |
| 3,648,437 | 3/1972 | Bridges | 323/903 X |
| 3,873,282 | 3/1975 | Finch | 323/903 X |
| 4,152,124 | 5/1979 | Davis | 323/903 X |
| 4,267,502 | 5/1981 | Reese et al. | 323/903 X |
| 4,290,003 | 9/1981 | Lanese | 323/903 X |

FOREIGN PATENT DOCUMENTS 1148977 5/1963 Fed. Rep. of Germany .

OTHER PUBLICATIONS

Lektrofiltersteuerung mit direkter Durchbruchserfassung Von Alois Goller, Helmut Schummer und Lovro Vukasovic; Siemens-Zeitschrift, 1971, pp. 567-572.

*Primary Examiner*—William M. Shoop

*Attorney, Agent, or Firm*—Kenyon & Kenyon

[57] ABSTRACT

A system for automatically controlling the voltage of an electrostatic filter with respect to its breakdown voltage limit. The detection of secondary voltage breakdowns which occur within a post-breakdown time period after an initial voltage breakdown cause the filter voltage to be lowered to zero value. After a deionizing time period, the filter voltage is gradually raised during a predetermined rise time period until it reaches a new value. The duration of the deionizing time period and the rise time period may be advantageously computed in response to the history of voltage breakdowns, by a microcomputer system.

5 Claims, 3 Drawing Figures

SYSTEM FOR AUTOMATICALLY CONTROLLING THE BREAKDOWN VOLTAGE LIMIT OF AN ELECTROFILTER

BACKGROUND OF THE INVENTION

This invention relates generally to systems for controlling the voltage of an electrofilter, and more particularly, to a system which increases the filter voltage in accordance with a predetermined voltage-time characteristic until voltage breakdown occurs, the filter voltage being increased by a predetermined amount after the voltage breakdown.

The degree to which an electrostatic separator filter removes particulate matter from a gas increases as the operating voltage of the filter approaches the breakdown limit. Since the breakdown limit of the filter varies during operation as a function of factors such as gas composition, dust content, and temperature, the voltage of the electrostatic separator filter must be controlled as a function of the magnitude of the breakdown voltage.

Filter voltage control systems are known wherein the operating voltage of the filter is raised through the voltage breakdown limit of the filter, as a function of time. Upon the occurrence of one or more voltage breakdowns, the operating voltage of the filter is lowered by a definite, predetermined amount below the breakdown limit, the voltage being subsequently raised again to the breakdown limit.

One known system for controlling the voltage of an electrofilter is described in German reference DAS No. 11 48 977. The system described therein utilizes a control capacitor which is charged by means of a resistor in response to the magnitude of the filter current. A continuously controllable tube is connected in shunt across the control capacitor, the controllable tube being controlled by the voltage across a further capacitor. The further capacitor is charged to a voltage which corresponds to the voltage at the time of breakdown, the further capacitor being continuously discharged by a shunt resistor. A control device on the primary side of the electrofilter controls the operating voltage of the electrofilter in response to the voltage across the control capacitor. Additional methods and corresponding circuitry for controlling the voltage of an electrofilter are described in Siemens-Zeitschrift, 1971, pages 567 to 572. The known prior art systems do not alleviate the effects of a voltage breakdown which is immediately followed by one or more further breakdowns. Such multiple voltage breakdowns are undesirable because the filtering action is inhibited during the breakdowns.

It is, therefore, an object of this invention to develop a system for controlling the voltage of an electrofilter which reduces the number of secondary voltage breakdowns which follow an initial breakdown.

SUMMARY OF THE INVENTION

The foregoing and other objects are achieved by this invention which provides a system for controlling the voltage of an electrostatic filter whereby the operating voltage of the filter is reduced to zero after the occurrence of a secondary voltage breakdown which is defined as occurring within a preselected post-breakdown time interval after an initial voltage breakdown. The filter voltage is raised to a new value after a predetermined interval of time after having been brought to zero, in accordance with a predetermined rise time. The preselected post-breakdown time interval is selected to be somewhat longer than the sum of the predetermined interval and the time required to raise the filter voltage to the new value. This system, therefore, provides the criterion by which secondary voltage breakdowns are distinguished from initial voltage breakdowns, the control voltage of a control element being advantageously adjusted to minimize the occurrence of secondary voltage breakdowns.

In some embodiments of the invention, the correlation between the voltage and environmental conditions of the filter is improved by advantageously selecting the predetermined interval and the rise time of the filter voltage in response to the number of secondary breakdowns which occur within a preceding predetermined search period. Accordingly, if many secondary voltage breakdowns occur within the predetermined search period, the duration of the predetermined interval and the time required for the filter voltage to reach the new value are selected to be relatively long. Conversely, if few or no secondary voltage breakdowns occur within the preceding predetermined search period, the predetermined interval and the rise time are selected to be relatively short. In this manner, the control of the filter voltage is directly correlated with the occurrence of secondary voltage breakdowns. In addition to the foregoing, the duration of the preceding predetermined search period may be selected in response to the number of voltage breakdowns.

As previously indicated, the filter voltage and optionally the filter current are lowered after every breakdown. The percentage of the reduction in the breakdown voltage or current is advantageously selected in response to the frequency of voltage breakdowns within a fixed predetermined time.

The power supply of an electrofilter normally consists of a thyristor control element which is arranged between a transmission network and a high-voltage transformer, and a rectifier which is coupled thereto. In one embodiment, a microcomputer is advantageously used to determine the control voltage for the control element. The microcomputer computes the required control voltage in response to available data and stored operating parameters.

BRIEF DESCRIPTION OF THE DRAWINGS

Comprehension of the invention is facilitated by reading the following detailed description in conjunction with the annexed drawings, in which.

DETAILED DESCRIPTION

Figure 1:
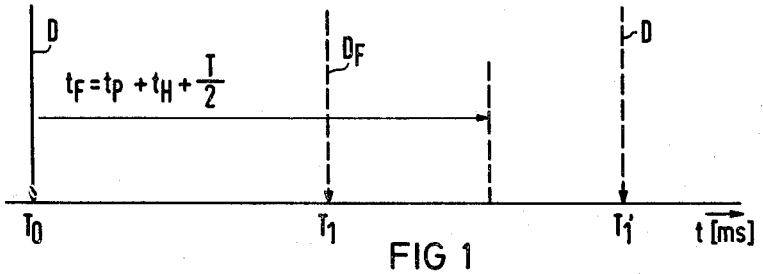
FIG. 1 is a timing diagram which is useful in illustrating the definition of the term "secondary voltage breakdown"

FIG. 1 is a timing diagram which is useful in illustrating the distinction between a primary voltage breakdown D and a secondary voltage breakdown $D_F$. In the figure, primary voltage breakdown D occurs at a time $T_0$. If a subsequent voltage breakdown occurs within a post-breakdown time interval $t_F$, for example, at a time $T_1$, such a voltage breakdown is considered to be a secondary voltage breakdown $D_F$. However, if a voltage breakdown D' occurs at a time $T'_1$, which is beyond the interval $t_F$, such a voltage breakdown would be considered to be a primary voltage breakdown.

The post-breakdown time interval $t_F$ is defined as:

$$t_F = t_P + t_H + T/2.$$

The interval of time represented by $t_p$ is understood to be the deionizing time which should pass prior to raising the voltage again after it has been reduced to zero. The deionizing time is advantageously selected in response to the frequency of the secondary voltage breakdowns during a preceding search. Thus, if many secondary voltage breakdowns occurred during the preceding search period, the duration of the deionizing time interval is increased.

The rise time $t_H$ is defined as the time interval during which the filter voltage is raised to the new value. As is the case with the deionizing time interval $t_P$, the rise time $t_H$ is advantageously selected in response to the frequency of secondary breakdowns during the preceding search period. In this embodiment, the rate of rise of voltage is decreased as the number of voltage breakdowns increases during the preceding search period. The calculation for the post-breakdown time further includes a time interval T/2, where T corresponds to the period of the network AC voltage. Thus, T corresponds to 20 milliseconds or $16\frac{2}{3}$ milliseconds for 50 hertz or 60 hertz systems, respectively.

Figure 2:
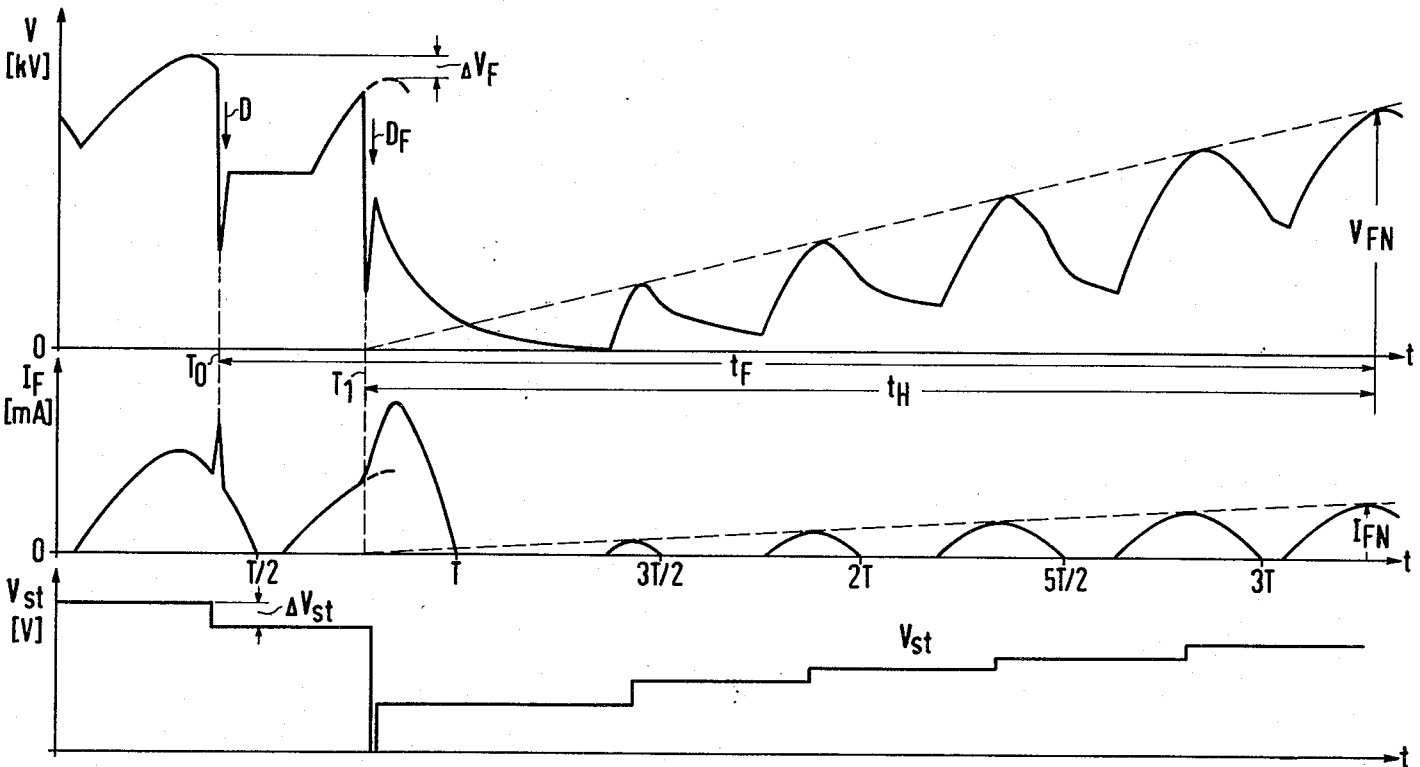
FIG. 2 illustrates the wave forms of the filter voltage, the filter current, and the control voltage of the control element, the wave forms being plotted on corresponding time scales.

FIG. 2 illustrates a plurality of wave forms which are shown on corresponding time scales. In this figure, voltage breakdown D occurs at time $T_0$, as is evident from the corresponding decrease in the filter voltage $V_F$, and the increase in the filter current $I_F$. In response to this primary voltage breakdown, the control voltage $V_{st}$ is reduced by an amount $\Delta V_{st}$, so as to cause the filter voltage $V_F$ to be reduced during the subsequent half-wave by an amount $\Delta V_F$. This reduction in filter voltage $\Delta V_F$ can be selected to be a percentage of the existing filter voltage.

FIG. 2 further shows a voltage breakdown $D_F$ occurring at a time $T_1$, the time $T_1$ being within the post-breakdown time $t_F$ after the time $T_0$ of the primary breakdown D. Accordingly, voltage breakdown $D_F$ is considered as a secondary breakdown. In response to the secondary voltage breakdown $D_F$, the control voltage $V_{st}$ is set to zero, thereby causing the filter voltage to be reduced accordingly. Since the voltage breakdown $D_F$ is the first secondary breakdown, the deionizing time is not considered and the filter voltage is raised in steps within the time interval $t_H$ until it reaches a new value $V_{FN}$ of the filter voltage, with a corresponding current value $I_{FN}$. Beyond this point in time, the filter voltage is increased with time in a known manner until the voltage breakdown limit is reached once again.

Figure 3:
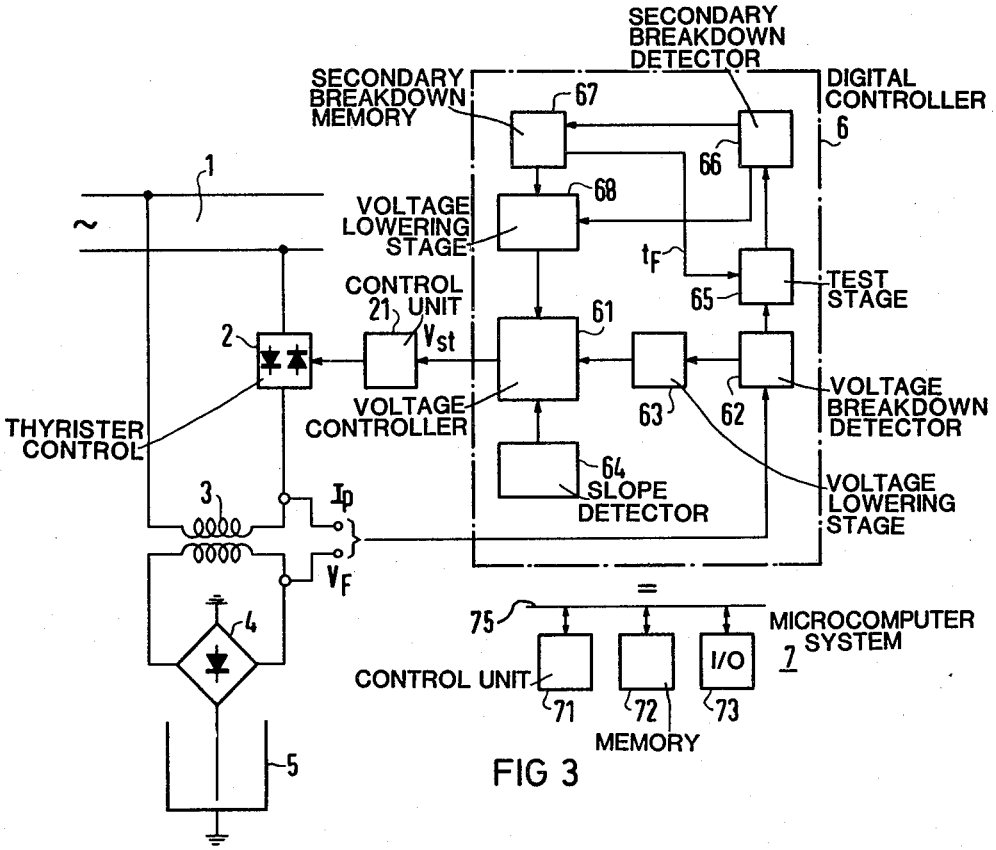
FIG. 3 is a schematic and block and line representation of an electrostatic filter and its associated control circuitry which operate in accordance with the inventive control system.

FIG. 3 is a schematic and block and line representation of a circuit arrangement which controls the voltage of an electrostatic filter in accordance with the wave forms of FIG. 2. In FIG. 3, an AC network 1 supplies electrical energy to a primary winding of a high-voltage transformer 3 by means of a thyristor control element 2. A secondary winding of high-voltage transformer 3 is coupled to a rectifier 4 which supplies a DC voltage to the electrofilter 5. Control voltage $V_{st}$ is coupled at an input terminal of a control unit 21 which controls the conductive state of the thyristor control element 2. Control voltage $V_{st}$ is provided at an output of a digital controller 6. A microcomputer system 7 is, as indicated by the equal sign, the equivalent of digital controller 6. Microcomputer system 7 is provided with a central unit 71, a memory 72, and a plurality of input/output devices 73 which are coupled to one another by a bus 75. The functions of the control system, however, are more easily understood by referring to the functional modules contained in digital controller 6.

Digital controller 6 is provided with a voltage breakdown detector 62 which derives voltage breakdown criteria from primary current $I_P$ and/or the filter voltage $V_F$. This system determines whether the voltage in the prevailing half-wave of the DC filter voltage is less than the corresponding values of the same phase angle in the preceding half-wave of the DC filter voltage. If a voltage breakdown occurs, a correspondingly reduced control voltage $V_{st}$ is generated by a voltage-lowering stage 63 which, by means of a voltage controller 61 reduces the filter voltage by a value $\Delta V_F$. After a predetermined time interval, the filter voltage is raised in accordance with a predetermined slope until the breakdown voltage limit is reached. The predetermined slope is selected by a slope selector 64. The above-described cycle is repeated after reaching the breakdown voltage limit.

In addition to primary voltage breakdown D, this system also detects secondary breakdowns $D_F$. A secondary breakdown detector 66 detects the secondary breakdowns, and is connected to breakdown detector 62 by a test stage 65. Test stage 65 reports breakdowns which occur within the post-breakdown time $t_F$ as secondary breakdowns to the secondary breakdown detector 66. In response, secondary breakdown detector 66 causes, by means of a further voltage-lowering stage 68, a reduction of the filter voltage, or the value of the control voltage to fall to zero, and the control voltage to rise slowly until a predetermined new voltage value is reached. Since the deionizing time interval $t_P$ and the rise time $t_H$, as well as the post-breakdown time $t_F$, are functions of the frequency of secondary voltage breakdowns within a predetermined search period, a value proportional to the number of secondary voltage breakdowns within the predetermined search period is stored in a secondary breakdown memory 67 and is used as the corresponding variable for determining the post-breakdown time, the deionizing time, and the rise time.

Although the invention has been described in terms of specific embodiments and applications, other embodiments and applications, in light of this teaching, would be obvious to persons skilled in the art. Accordingly, the drawings and descriptions in this disclosure are merely illustrative of the invention and should not be construed to limit the scope thereof.

What is claimed is:

1. A method for automatically controlling the voltage of an electrostatic filter with respect to its breakdown voltage limit, the method having the steps of increasing the filter voltage as a function of time until a voltage breakdown is detected, and reducing the filter voltage by a predetermined amount after the voltage breakdown is detected, the invention comprising the further steps of:

(a) detecting a secondary voltage breakdown following an initial voltage breakdown, said secondary voltage breakdown occurring within a first predetermined time interval after said initial voltage breakdown;

(b) lowering the filter voltage to a zero value after detecting said secondary voltage breakdown; and (c) raising the filter voltage after a second predetermined time interval to a new filter voltage value, said raising of the filter voltage occurring over a third predetermined time interval, said first predetermined time interval being longer than the sum of said second and third predetermined time intervals.

2. The method of claim 1 wherein said second and third predetermined time intervals are selected in response to a number of secondary voltage breakdowns which occur during a preceding predetermined search period.

3. The method of claim 2 wherein the duration of said preceding predetermined search period is determined in response to the frequency of said secondary voltage breakdowns.

4. The method of claim 1 wherein there is further provided the step of lowering the filter voltage after said initial voltage breakdown, said filter voltage being lowered by a selectable percentage amount of said filter voltage, said percentage amount of said filter voltage being selectable in response to the frequency of the voltage breakdowns which occur during a predetermined prior period of time.

5. An arrangement for automatically controlling the voltage of an electrostatic filter with respect to its breakdown voltage limit, the arrangement having a transformer which is coupled at its primary winding to an AC network by a control element, and at its secondary winding to a rectifier for supplying DC energy to the electrostatic filter, the arrangement being of the type which is further provided with a microcomputer system for computing a control voltage which controls the control element, the computation being performed from measured data and stored operating parameters, the arrangement further comprising:

detector means for detecting secondary breakdowns which occur within a predetermined period of time after a primary breakdown;

secondary breakdown memory means for storing data pertaining to a number of secondary breakdowns within said predetermined period of time; and voltage lowering means for lowering the voltage of the electrostatic filter.

* * * * *